US007055817B2

(12) United States Patent
Werner et al.

(10) Patent No.: US 7,055,817 B2
(45) **Date of Patent: *Jun. 6, 2006**

(54) FRICTION WHEEL SEPARATOR FOR SEPARATING SHEETLIKE ITEMS

(75) Inventors: Frank Werner, München (DE); Alois Wagner, Olching (DE)

(73) Assignee: Giesecke & Devrient GmbH, Munich (DE)

( * ) Notice: Subject to any disclaimer, the term of this patent is extended or adjusted under 35 U.S.C. 154(b) by 226 days.

This patent is subject to a terminal disclaimer.

(21) Appl. No.: 10/203,636

(22) PCT Filed: Feb. 19, 2001

(86) PCT No.: PCT/EP01/01843

§ 371 (c)(1),
(2), (4) Date: Nov. 20, 2002

(87) PCT Pub. No.: WO01/62639

PCT Pub. Date: Aug. 30, 2001

(65) Prior Publication Data

US 2003/0107165 A1 Jun. 12, 2003

(30) Foreign Application Priority Data

Feb. 22, 2000 (DE) ..... 100 08 135

(51) Int. Cl.
*B65H 3/52* (2006.01)

(52) U.S. Cl. ..... 271/121

(58) Field of Classification Search ..... 271/121, 271/122, 125

See application file for complete search history.

(56) References Cited

U.S. PATENT DOCUMENTS 2,214,752 A * 9/1940 Pierce ..... 271/120

(Continued)

FOREIGN PATENT DOCUMENTS

DE 2401530 A 7/1975

(Continued)

*Primary Examiner*—Kathy Matecki
*Assistant Examiner*—Matthew J. Kohner
(74) *Attorney, Agent, or Firm*—Bacon & Thomas, PLLC

(57) ABSTRACT

A friction wheel singler is proposed for singling sheet material, in particular bank notes, comprising sheet magazine 5 for receiving stack of sheets 1, singling cylinder 2 having one or more friction elements 4 for contacting and conveying sheet 1*a* to be singled out of the magazine, and retaining device 3 forming with singling cylinder 2 singling gap 7 through which sheets 1*a* to be singled out of the magazine are conveyed one by one, retaining device 3 having one or more friction areas 3*a* for contacting sheets 1*a* to be singled out of magazine 5. Friction elements 4 of singling cylinder 2 and friction areas 3*a* of retaining element 3 have the same friction material, whereby different frictional forces transferred to sheet 1*a* by singling cylinder 2, on the one hand, and retaining device 3, on the other hand, are obtained by selecting the contact area between friction elements 4 of singling cylinder 2 and sheet 1*a* to be singled to be substantially larger than the contact area between friction areas 3*a* of retaining element 3 and sheet 1*a* to be singled. Any further contact areas of retaining device 3 and/or singling cylinder 2 with the sheet to be singled have a substantially lower coefficient of friction than the friction material of friction elements 4 of singling cylinder 2 and friction areas 3*a* of retaining element 3.

According to a special aspect of the invention, it is proposed that the sheet material is deposited in sheet magazine 5 on driven feed rolls 11 to 14 to guarantee a reliable supply of sheets to be singled to singling gap 7 regardless of the stack height.

18 Claims, 3 Drawing Sheets

U.S. PATENT DOCUMENTS

| | | | | | |
|---|---|---|---|---|---|
| 4,474,365 | A | | 10/1984 | DiBlasio | |
| 4,496,145 | A | * | 1/1985 | Fukui | 271/122 |
| 4,526,358 | A | * | 7/1985 | Ura et al. | 271/34 |
| 4,560,154 | A | | 12/1985 | Nogi et al. | |
| 4,653,742 | A | * | 3/1987 | Sasaki et al. | 271/114 |
| 4,674,736 | A | * | 6/1987 | Tsubo | 271/122 |
| 4,779,861 | A | * | 10/1988 | Ozawa et al. | 271/119 |
| 4,871,162 | A | | 10/1989 | Imai et al. | |
| 4,921,238 | A | * | 5/1990 | Lane | 271/37 |
| 4,993,587 | A | * | 2/1991 | Abe | 221/21 |
| 5,029,840 | A | * | 7/1991 | Haga et al. | 271/122 |
| 5,118,091 | A | * | 6/1992 | Nagamoto et al. | 271/122 |
| 5,143,366 | A | * | 9/1992 | Svyatsky | 271/122 |
| 5,207,788 | A | * | 5/1993 | Geib et al. | 271/122 |
| 5,374,048 | A | | 12/1994 | Takahashi | |
| 5,769,411 | A | * | 6/1998 | Nakagawa et al. | 271/122 |
| 5,934,665 | A | * | 8/1999 | Kasahara | 271/122 |
| 6,000,689 | A | * | 12/1999 | Furuki et al. | 271/10.11 |
| 6,305,684 | B1 | * | 10/2001 | Lightner et al. | 271/122 |

FOREIGN PATENT DOCUMENTS

| | | | | |
|---|---|---|---|---|
| DE | 2424360 | A | | 12/1975 |
| DE | 2849857 | A | | 5/1980 |
| DE | 3228528 | C2 | | 2/1983 |
| DE | 3805520 | A1 | | 9/1988 |
| DE | 4225086 | A1 | | 2/1993 |
| GB | 2035268 | A | | 6/1980 |
| GB | 2132737 | A | * | 7/1984 |
| JP | 05024716 | A | * | 2/1993 |
| JP | 07 309466 | A | | 11/1995 |

* cited by examiner

FRICTION WHEEL SEPARATOR FOR SEPARATING SHEETLIKE ITEMS

BACKGROUND

This invention relates to a friction wheel singler for singling sheet material, in particular bank notes, comprising a sheet magazine for receiving a stack of sheets, a singling device with a singling cylinder having one or more friction elements for contacting and conveying a sheet to be singled out of the magazine, and a retaining device forming with the singling cylinder a singling gap through which sheets to be singled out of the magazine are conveyed one by one, the retaining device having one or more friction areas for contacting sheets to be singled out of the magazine.

Friction wheel singlers are used for quickly singling stacks of sheets, for example bundles of bank notes, in the transverse or longitudinal direction so that the singled note can be supplied to a sensor system for determining the authenticity, qualitative nature, value or other characteristic properties of the note.

Friction wheel singlers are based on the principle of a singling cylinder attacking the surface of a note of a bank note stack for example, this specifically contacted note being conveyed in a transport direction due to friction by rotation of the singling cylinder while the other notes of the bank note stack are retained by a retaining device. The retaining device and singling cylinder form for this purpose a singling gap through which the note is conveyed. The retaining device can slightly engage grooves of the singling cylinder, the engagement depth being adjustable. To ensure that the note contacted by the singling cylinder is conveyed and the other notes of the bank note stack retained, a higher force must be exerted on the note in the singling gap by the singling cylinder than by the retaining device on the opposite side of the gap. Therefore, the singling cylinder is usually provided with friction elements whose friction linings have a substantially higher coefficient of friction than the corresponding friction linings of the retaining device, the ratio of coefficients of friction being about 2:1 for example.

It proves to be disadvantageous that the different friction materials of the singling cylinder and the retaining device partly show very different operating characteristics, for example with respect to resistance to environmental influences, moisture absorption, temperature coefficient, aging and wear resistance. This can lead to different service lives and influences the ratio of friction, which can lead to singling errors or even double picks, i.e. more than one sheet being grasped by the singling cylinder.

Singling errors can also occur for other reasons. It is thus usual for the stack of sheets to rest on a supporting plate in the sheet magazine, with feed rolls disposed on a common axle protruding out of the front area (in the sheet transport direction) of the supporting plate in the manner of a hopper. Said feed rolls contact the underside of the lowermost sheet of the stack, thereby lifting the stack from the supporting plate in this area, and convey the lowermost sheet or the stack toward the singling device. Singling gaps occasionally occur when, for example, the sheet material is especially large and the stack of sheets especially heavy (in which case the frictional force between stack and supporting plate is too great), or when the last sheet or sheets to be singled are not, or not completely, grasped by the feed rolls due to a sheet arch.

Singling errors often occur in the singling of stacks of sheets of different kinds and qualities, e.g. bank note stacks with used notes of very different denominations.

GB 2 035 268 A and JP 07 309466 A moreover disclose friction wheel singlers using friction material with approximately the same coefficient of friction for both singling cylinder and retaining cylinder. However, in these friction wheel singlers both singling cylinder and retaining cylinder must be driven. Moreover, the known friction wheel singlers do not permit synchronous singling.

SUMMARY

The problem of the present invention is thus to provide a friction wheel singler for singling sheet material, in particular mixed-format bank notes in poor condition, that has a low risk of singling errors, singles reliably after a long operating time and under very different ambient conditions, and singles sheet material at defined intervals.

According to the first aspect of the invention, the friction elements of the singling cylinder and the friction areas of the retaining device have the same friction material or friction material with the same coefficient of friction. This means that they have the same wear resistance, environmental resistance, moisture absorption, temperature expansion coefficient, aging and the like, so that the ratio of friction of the friction materials remains unaffected by such parameters and the service life of the friction wheel singler increases while the singling quality is constant.

To ensure that the singling cylinder force acting on the sheet material to be singled is sufficiently far above the force exerted by the retaining device despite the use of substantially the same friction material, it is in addition provided that the contact area—whether areal or linear—between the sheet material and the friction elements of the singling cylinder is substantially greater than the contact area between the sheet material and the friction areas of the retaining device. The term "contact area" is to be understood in connection with the present invention to mean that an overlap of singling cylinder and retaining device causes a perpendicular singling force and a perpendicular equal force to be exerted by singling cylinder and retaining device on the sheet material to be singled, which leads to singling and retaining forces corresponding to the coefficients of friction of the friction material and the effective area of the friction material. Preferably, half of the area of the retaining device is formed by a material with a negligibly low coefficient of friction. The ratio of the particular active area with friction material is then about 2:1. This ratio simultaneously determines the ratio of frictional forces between singling cylinder and retaining device because of the substantially identical friction materials, regardless of the condition or age of the friction material.

The influence of any further contact areas between retaining device and/or singling cylinder, on the one hand, and the sheet material to be singled, on the other hand, is kept low because such further contact areas are equipped with a substantially lower coefficient of friction than the areas of the retaining device and singling cylinder with friction material. The surfaces of the retaining device and singling cylinder in such further contact areas preferably consist of smooth metal, smooth plastic or another smooth material so that the frictional influence of said further contact areas is negligibly small compared to the frictional forces exerted on the sheet material to be singled by the areas with friction material.

In connection with synchronous singling of sheet material, that is, singling of sheet material at defined intervals between consecutive singled sheets, the friction elements of the singling cylinder are formed as friction segments only over a limited circumference of the singling cylinder. Sheet material is thus singled only when the friction segments come in contact with sheet material in the singling gap. Only then is the frictional force applied by the singling cylinder to the bank note to be singled higher than the frictional force of the retaining device. When the singling cylinder contacts sheet material outside the friction segments only with its smooth surface, however, the frictional force transferred to the sheet material is lower than the frictional force of the retaining device so that the sheet material is retained. This specifically means that a friction segment of the singling cylinder with a predetermined contact area or line has disposed opposite at the singling gap a retaining element of the retaining device that has a friction area with the same coefficient of friction as the friction segment of the singling cylinder, on the one hand, and a sliding area, for example of smooth metal, on the other hand, the contact areas or lines of the friction and sliding areas of the retaining device each corresponding to half the contact area or line of the friction segment of the singling cylinder. When the friction segment of the singling cylinder is located in the area of the singling gap, the ratio of friction contact areas between singling cylinder and retaining device is 2:1, so that sheet material is singled. After the friction segment has moved out of the area of the singling gap, the ratio between the friction contact areas of the singling cylinder and the retaining device is about 0:1, so that sheet material is retained.

The retaining element of the retaining device can preferably be formed by a freewheeling retaining roll or by retaining pads or a combination of retaining roll and retaining pad. A retaining pad, straight or in particular also curved, supports the guidance of the bank note around the singling cylinder but is subject to higher wear due to the sliding friction between note and block. The retaining roll held with freewheeling, on the other hand, permits higher service lives due to lower wear, since the freewheeling guarantees that the retaining roll is worn over its total circumference. It is therefore advantageous to combine retaining pads with sliding areas and retaining rolls with friction areas in the retaining device.

It is preferably provided that the support plane on which the stack of sheets rests in the sheet magazine is formed by a plurality of feed rolls disposed one after the other in the transport direction of the sheet material and disposed on driven shafts. The feed rolls are preferably distributed on the shafts over the total width of the support plane, and the shafts with the feed rolls over the total length of the support plane. The stack of sheets thus rests only on rolls, so that rolling frictional forces substantially occur in the support plane, which are lower compared to sliding frictional forces. The feed rolls disposed one after the other in the transport direction over the total length of the support plane with feed rolls over the total width of the support plane form a virtually all-over, effective feed for the supported stack of sheets up to the last sheet to be singled.

A preferred embodiment provides that the feed rolls are equipped over a limited circumference with friction segments having a high coefficient of friction relative to the remaining feed roll surface, the friction segments of all feed rolls on their associated shafts assuming the same angular position with respect to the support plane. If thus disposed feed rolls are synchronized with a singling cylinder likewise equipped with friction segments, especially reliable singling can be achieved if the friction segments of the singling cylinder take effect, that is, single sheet material, at the singling gap at the moment when the friction segments of the feed rolls are dipping into the support plane and thus not exerting any appreciable propulsion on the sheet to be singled.

A further preferred embodiment provides that the back feed rolls in the transport direction are equipped with a lower coefficient of friction than the feed rolls disposed therebefore in the transport direction, which prevents higher forces from occurring on the trailing edges of the sheet material to be singled than on the leading edges.

BRIEF DESCRIPTION OF THE DRAWINGS

In the following, the invention will be described by way of example by individual embodiments with reference to the associated drawings, in which.

DESCRIPTION OF VARIOUS EMBODIMENTS

Figure 1A:
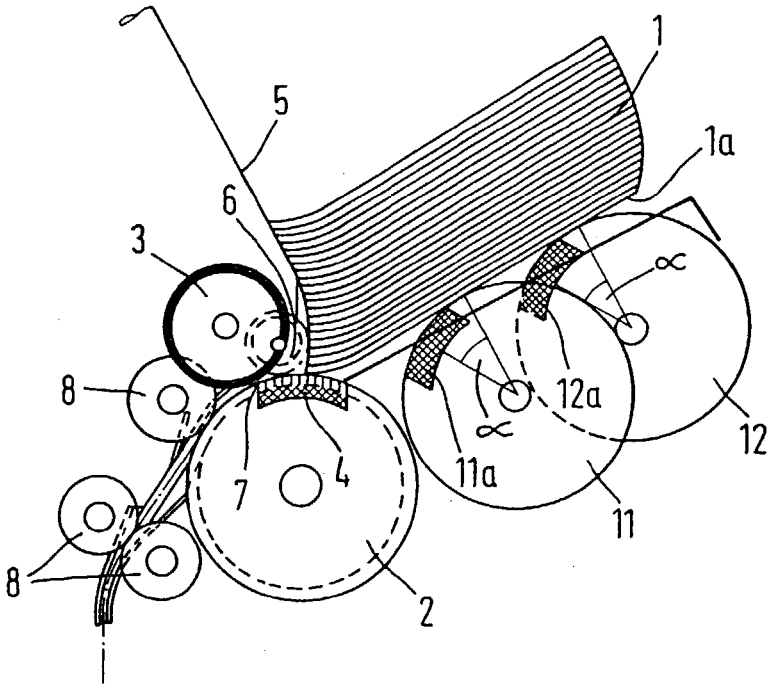
FIGS. 1*a, b* show a cross section through and a plan view of a friction wheel singler for singling bank notes in cross format.
Figure 1B:
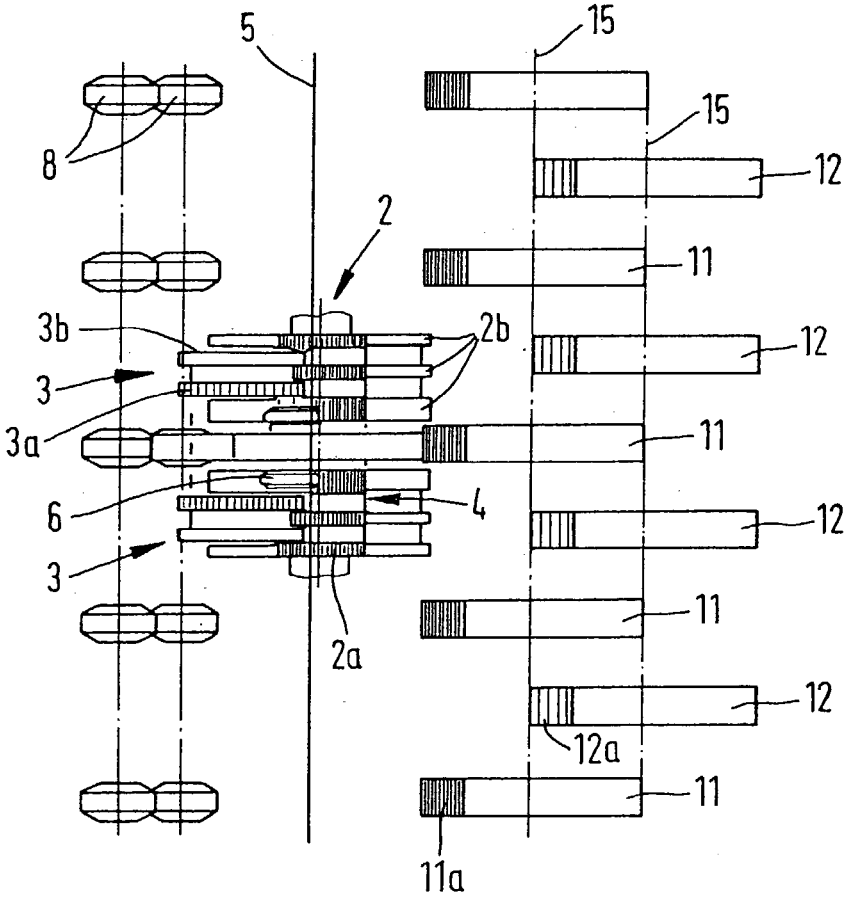

FIG. 1*a* shows a friction wheel singler in cross section, and FIG. 1*b* the same friction wheel singler in a plan view. Bank note stack 1 is placed in the friction wheel singler in cross format. Lowermost note 1*a* to be singled next thus lies with its long side against singling cylinder 2. The force with which bank note stack 1 deposited in sheet magazine 5, formed here as a slanted guiding plate, acts on singling cylinder 2 is determined solely by gravity and therefore depends on the weight and thus substantially the height of bank note stack 1.

Singling cylinder 2 can be equipped with a friction lining over its complete circumference if continuous singling of notes with no interval between individual notes is desired. However, notes should usually be singled at a certain interval apart. For this purpose the circumferential surface of singling cylinder 2 has provided therein friction segment 4 having a high coefficient of friction compared to the remaining circumferential surface of cylinder 2. Said remaining circumferential surface of cylinder 2 consists of smooth material, preferably smooth metal or smooth plastic.

Press-down rolls 6 ensure that sheet 1*a* to be singled is supplied to singling gap 7 formed by singling cylinder 2 with retaining device 3 formed as a retaining roll. Retaining roll 3 is formed as a freewheeling roll, the direction of freewheeling allowing rotation of retaining roll 3 contrary to the direction of singling of sheet material to be singled. Freewheeling is always triggered for example by machine vibrations when no stack of sheets is placed on. Retaining roll 3, due to suitable geometrical division of its surface into friction areas 3*a* and smooth sliding areas 3*b*, exerts only half as much frictional force on note 1*a* to be singled as friction segment 4 of singling cylinder 2, whereby the friction materials of friction segment 4 of singling cylinder 2, on the one hand, and friction areas 3*a* of retaining roll 3, on the other hand, have a coefficient of friction that is substantially equal. The same friction materials are preferably used. This will be explained in more detail below with reference to FIGS. 3*a*, 3*b*. Note 1*a* singled through singling gap 7 is supplied with the aid of downstream transport rolls 8 to a processing device not shown, which determines the quality or value of the note for example.

In FIG. 1*b* it can be seen that singling cylinder 2 and retaining rolls 3 have circumferential grooves. The circumferential grooves of retaining rolls 3 are offset from the circumferential grooves of singling cylinder 2 and adapted in their width so that retaining roll 3, which is designed to be displaceable, can dip into the grooves of singling cylinder 2 to increase the frictional forces. Friction segments 4 of singling cylinder 2 are marked by hatching, as are friction areas 3*a* of retaining roll 3. Sliding areas 3*b* of retaining roll 3 and smooth sliding surfaces 2*b* of singling cylinder 2 have no hatching, in contrast.

Figure 3A:
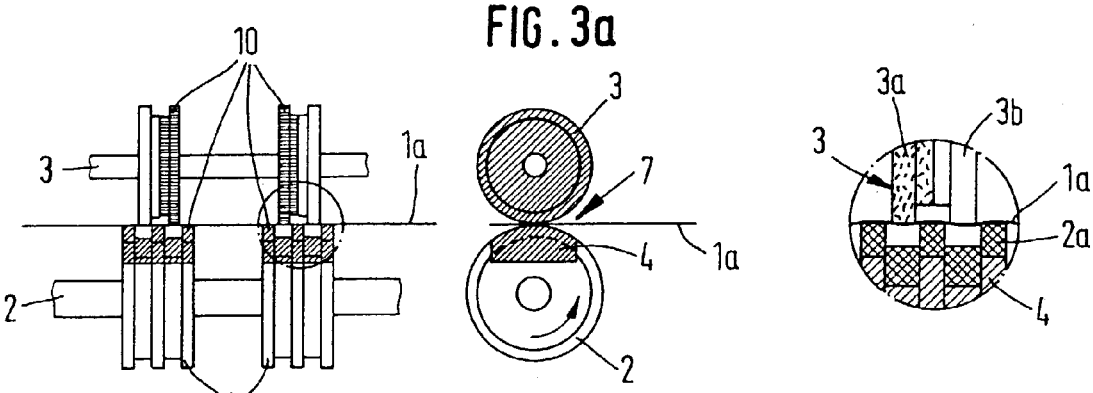
FIGS. 3*a, b* show an embodiment of the singling device and retaining device of the present invention.
Figure 3B:
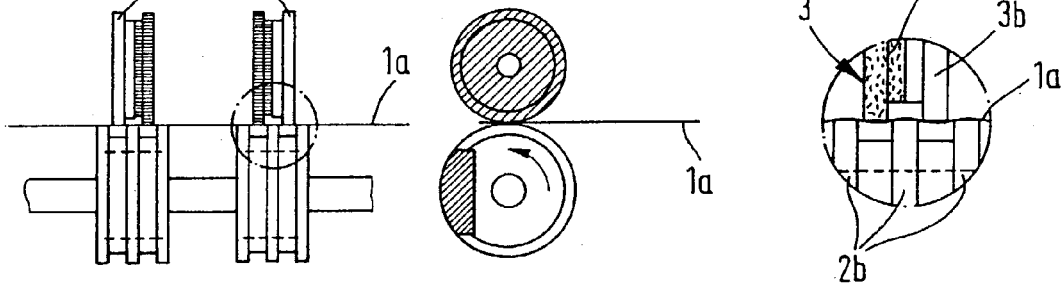

With reference to FIGS. 3*a*, 3*b* the principle of singling and retaining sheet material will now be described. FIG. 3*a* shows singling cylinder 2 and retaining roll 3 in cross section from the front (left picture) and in cross section from the side (middle picture) as well as a detail (right picture) of the left picture.

Singling cylinder 2 is in an effective position with friction segment 4 in FIG. 3*a*. That is, friction segment 4 forms together with retaining roll 3 singling gap 7 through which note 1*a* to be singled is guided (middle picture). Friction linings 10 or friction areas 2*a*, 2*b* of friction segment 4, on the one hand, and retaining roll 3, on the other hand, preferably consist of the same friction material but have at least substantially the same coefficient of friction. Reference no. 9 designates the smooth surfaces or sliding areas 2*b*, 3*b* of singling cylinder 2, on the one hand, and retaining rolls 3, on the other hand (left picture).

The detail shown in the right picture of FIG. 3*a* illustrates the effective ratio of the retaining force produced by retaining roll 3 to the singling force applied by friction segment 4 of singling cylinder 2. On retaining rolls 3 two edges of associated friction area 3*a* are effective on note 1*a* to be singled, and on friction segment 4 four edges of friction area 2*a* are effective on note 1*a* to be singled. The edges of sliding areas 3*b* of retaining roll 3 exert a negligibly low retaining force on sheet 1*a* to be singled in comparison to friction areas 3*a*, resulting altogether in a ratio of retaining force to singling force of 1:2. A different geometrical division of friction lining surfaces 2*a*, 3*a* to smooth surfaces 2*b*, 3*b* can of course be used to achieve different ratios. In any case the singling force clearly outweighs the retaining force when friction segment 4 is effective on singling gap 7, so that sheet 1*a* to be singled is conveyed through gap 7.

It can be derived from FIG. 3*b* in corresponding fashion which ratio of retaining force to singling force arises when friction segment 4 of singling cylinder 2 has been moved out of the effective position, that is, out of singling gap 7, with an otherwise identical geometrical design of the friction wheel singler. As can be seen from the right picture of FIG. 3*b*, two edges of friction areas 3*a* and two edges of negligible sliding areas 3*b* of retaining roll 3 still act on sheet 1*a* to be singled. Simultaneously, only four edges of negligible sliding areas 2*b* of singling cylinder 2 act on the opposite side of sheet 1*a* to be singled, resulting in a ratio of friction between retaining roll 3 and singling cylinder 2 of 1:0. A sheet lying against singling gap 7 is thus not singled but retained until friction segment 4 of singling cylinder 2 takes effect at gap 7 again.

Retaining roll 3 need not necessarily be formed as free-wheeling. Its friction linings 3*a* and smooth areas 3*b* can also be designed singly or both as fixed elements. Singling cylinder 2 also need not necessarily be segmented but can also be unsegmented, i.e. have no friction segments 4, for the abovementioned case of asynchronous singling. Moreover, retaining roll 3 and singling cylinder 2 can be formed of individual disks or rings that are individually placed on shafts and fixed thereon at desired positions. The individual rings or disks are advantageously selected so that the above-described grooves result when the rings or disks are disposed on the shafts.

Figure 4:
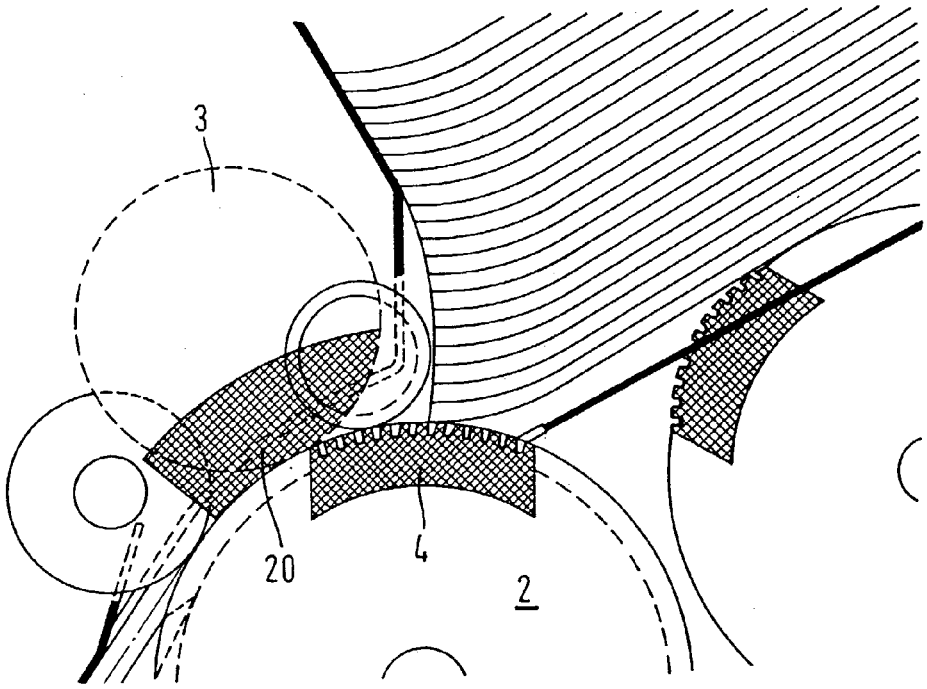
FIG. 4 shows a detail of the friction wheel singler according to FIGS. 1 and 2 wherein the retaining device includes a retaining pad.

FIG. 4 shows an enlarged detail of the friction wheel singler shown in FIG. 1*a*. However, in the embodiment shown in FIG. 4 retaining element 3 is not realized as a retaining roll but as retaining pad 20. Retaining pad 20 has a curvature adapted to the surface of singling cylinder 2, but can also be of rectilinear design on the side facing cylinder 2. Retaining pad 20 also has grooves to permit cooperation with singling cylinder 2 in the above-explained fashion. Retaining pad 20 shown in FIG. 4 has friction areas and sliding areas therebehind, which are not visible in the selected sectional view because of the identical geometry. The friction areas are divided up geometrically in relation to the contact area of friction segment 4 of singling cylinder 2 so that a sufficiently great ratio of singling force to retaining force arises when friction segment 4 is completely effective.

The wear of retaining pad 20 on its friction areas is comparatively high, however, due to the sliding friction with the sheet material to be singled. An embodiment is therefore preferred in which retaining rolls and retaining pads are combined, friction areas 3*a* being formed on the retaining rolls and retaining pads 20 having sliding areas 3*b*. Retaining pads 20 then consist of smooth material, e.g. smooth metal or smooth plastic.

In FIG. 1*a* it can in addition be seen that bank note stack 1 rests with lowermost note 1*a* to be singled on feed rolls 11, 12. As to be seen in FIG. 1*b*, a plurality of feed rolls 11 and a plurality of feed rolls 12 are distributed on shafts 15 mounted one behind the other in the transport direction of note 1*a* to be singled over the total width of said shafts 15, resulting in an all-over effective feed over the total support width and support length of the sheet magazine. Shafts 15 are driven in order to feed sheet 1*a* to be singled up to singling gap 7, unlike what is shown in FIG. 1*a*.

Uniform support of bank note stack 1 with as many support points as possible in the support plane is obtained by feed rolls 11 being offset from feed rolls 12 so that they closely adjoin shaft 15 of the closest feed rolls (FIG. 1*b*).

Feed rolls 11, 12 consist of smooth material, e.g. smooth metal or smooth plastic, and have friction segments 11*a*, 12*a*. Friction segments 12*a* attacking the trailing edge (in the transport direction) of note 1*a* to be singled advantageously have a lower coefficient of friction than friction segments 11*a* of front feed rolls 11. This prevents a greater feed force from being exerted on the trailing edge of the note than on the leading area of the note, since uniform conveyance of note 1*a* to be singled can otherwise be problematic.

Friction segments 11*a*, 12*a* are all disposed on their associated shaft 15 at same angle $\alpha$ relative to the support plane of bank note stack 1 (FIG. 1*a*). Since shafts 15 are driven in synchronism, friction segments 11*a*, 12*a* simultaneously come in contact with note 1*a* to be singled to be supplied to singling gap 7 and also simultaneously dip down into the support plane again. The dip-down moment is shown in FIG. 1*a*. At this moment the feed function of feed rolls 11*a*, 12*a* is substantially over since the feed effect of feed rolls 11, 12 is now low outside friction segments 11*a*, 12*a*. At the latest when friction segments 11*a*, 12*a* dip down into the support plane, stack of sheets 1 and in particular next note 1*a* to be singled should lie against singling gap 7. But singling of note 1*a* is effected only when friction segment 4 of singling cylinder 2 takes effect, that is, when friction segment 4 reaches singling gap 7, as described above. It is therefore provided that friction segment 4 of singling cylinder 2 enters singling gap 7 and takes effect exactly at the moment when friction segments 11*a*, 12*a* of feed rolls 11, 12 dip down into the support plane, as shown in FIG. 1*a*.

The frictional forces of friction segments 11*a*, 12*a* are in total below the frictional forces of retaining device 3, since singling would otherwise be effected solely due to the feed force applied by feed rolls 11, 12 on the sheet to be singled. The coefficient of friction of friction segments 11*a*, 12*a* is to be correlated accordingly with the coefficient of friction of friction areas 3*a* of retaining device 3, assuming a maximum stack of 500 sheets.

Figure 2A:
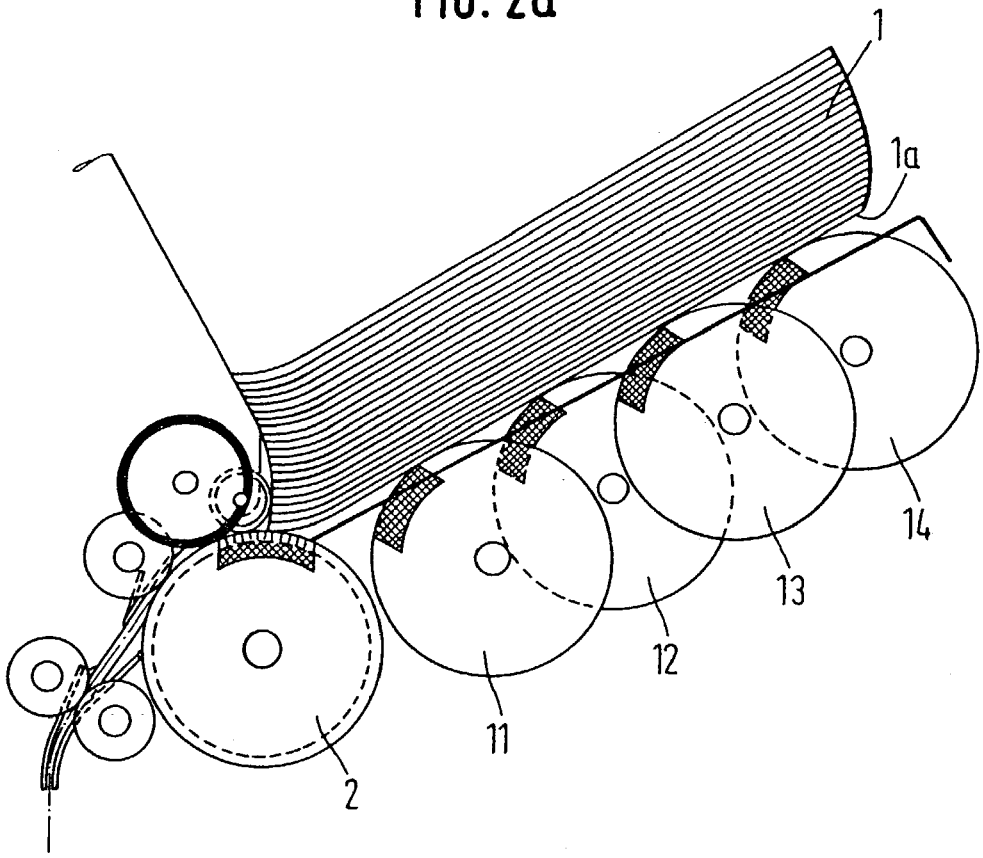
FIGS. 2*a, b* show a cross section through and a plan view of a friction wheel singler for singling bank notes in long format.
Figure 2B:
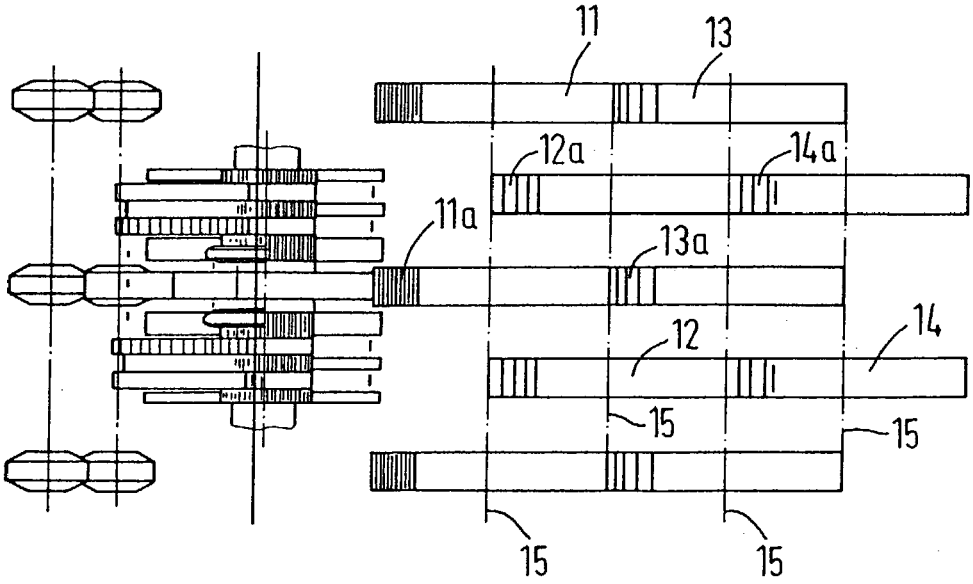

FIGS. 2*a* and 2*b* show a friction wheel singler comparable to the friction wheel singler according to FIGS. 1*a*, 1*b*, but for singling bank note stack 1 in long format rather than cross format. Four instead of two shafts 15 are accordingly provided with feed rolls 11, 12, 13, 14 distributed over the shaft length, the width of shafts 15 being selected in accordance with the maximum width of the notes to be singled and the number and distance of shafts 15 in accordance with the maximum length of notes to be singled. Feed rolls 11 to 14 again consist of smooth material, e.g. smooth metal or smooth plastic, and have friction segments 11*a* to 14*a*, whereby friction segments 12*a* to 14*a* of feed rolls 12 to 14 attacking the trailing end (in the transport direction) of note 1*a* to be singled have a friction material with a lower coefficient of friction than friction segments 11*a* of feed rolls 11 located on the front shaft (in the transport direction).

Additionally or alternatively to the choice of different friction materials for the friction segments of back feed rolls 12 to 14, on the one hand, and front feed rolls 11, on the other hand, it can be provided that friction segments 11*a* protrude slightly out of the circumferential plane of feed rolls 11 and thus also of the support plane, so that the bank note stack is slightly lifted. Friction segments 11*a* thus act as a hopper and transfer more feed force to note 1*a* to be singled than friction segments 12*a* to 14*a* of downstream feed rolls 12 to 14, the friction material otherwise being identical. Friction segments 12*a* to 14*a*, on the other hand, are flush with the circumferential surface of feed rolls 12 to 14. Friction segments 11*a* of front feed rolls 11 can be profiled to increase the frictional adhesion, just like friction segments 4 of singling cylinder 2. Such a hopper can of course also be realized for the above-described embodiment according to FIGS. 1*a*, *b* for singling in the transverse direction.

Synchronization of feed rolls 11, 12 or 11 to 14 with feed roll 2 is facilitated by the circumference of feed rolls 11 to 14 and of singling cylinder 2 being identical. Feed rolls 11, 12 or 11 to 14 feed the note to the singling gap preferably at their surface speed, which corresponds to the transport speed of the note after singling has been effected. Deviating from this, it is also possible to use feed rolls 11, 12 or 11 to 14 synchronized with singling cylinder 2 or with friction segment 4 that have a smaller diameter and thus a lower surface speed. In such a solution, lowermost note 1*a* in bank note stack 1 slides slightly over feed rolls 11, 12 or 11 to 14 after being grasped in singling gap 7 because of the lower surface speed of feed rolls 11, 12 or 11 to 14. However, since feed rolls 11, 12 or 11 to 14 consist of smooth material in these areas, as described above, the frictional forces that take effect are very low and can be neglected.

The invention claimed is:

1. A friction wheel singler for singling sheet material, comprising:

a sheet magazine for receiving a stack of sheets, a singling cylinder having one or more friction elements for contacting and conveying a sheet to be singled out of the sheet magazine, and a retaining device forming with the singling cylinder a singling gap through which sheets to be singled out of the sheet magazine are conveyed one by one, the retaining device having a circumferential friction area for contacting the sheets to be singled out of the sheet magazine, the friction area defined as half of the total circumferential area of the retaining device, the friction elements of the singling cylinder and the friction areas of the retaining device have friction material with substantially the same coefficient of friction, in the singling gap a first contact area located between the friction elements of the singling cylinder and a sheet to be singled is substantially greater than a second contact area located between the friction areas of the retaining device and the sheet to be singled, the friction elements of the singling cylinder are formed as friction segments over a limited circumference in the singling cylinder, and in the singling gap third contact areas of the retaining device and/or the singling cylinder with the sheet to be singled have a substantially lower coefficient of friction than the friction material of the friction elements of the singling cylinder and the friction areas of the retaining device.

2. The friction wheel singler according to claim 1, wherein the ratio of the contact area of the friction elements of the singling cylinder to the contact area of the friction areas of the retaining device in the singling gap is about 2:1.

3. The friction wheel singler according to claim 1 wherein the retaining device includes retaining rolls with the friction areas for contacting the sheets to be singled.

4. The friction wheel singler according to claim 1, wherein the retaining device includes a retaining pad for contacting the sheets to be singled.

5. The friction wheel singler according to claim 1, said retaining device including sliding areas, and wherein the retaining device has in addition to first contact areas between the friction areas and the sheet to be singled second contact areas between the sliding areas of the retaining device and the sheet to be singled, the sliding areas having a substantially lower coefficient of friction than the friction areas.

6. The friction wheel singler according to claim 5, wherein the retaining device includes one or more retaining rolls with friction areas and one or more retaining pads defining said sliding areas, said sliding areas arranged to contact the sheet to be singled.

7. The friction wheel singler according to claim 5, wherein the sliding areas of the retaining device are metal surfaces.

8. The friction wheel singler according to any of claim 1, wherein the retaining device and the singling cylinder have grooves in the singling gap in the conveying direction of the bank notes to be singled, the grooves of the retaining device and the grooves of the singling cylinder being offset from each other on opposite sides of the singling gap.

9. The friction wheel singler according to claim 8, wherein the retaining device dips into the grooves of the singling cylinder.

10. The friction wheel singler according to claim 1, including a plurality of feed rolls that contact the sheet of the stack of sheets resting on a support plane of the sheet magazine and convey it in a transport direction, so that the singling cylinder is provided downstream of the feed rolls in the transport direction of the sheet to be singled, and a plurality of feed rolls is disposed in the support plane on driven shafts disposed one after the other in the transport direction are provided.

11. The friction wheel singler according to claim 10, wherein the feed rolls are distributed on the shafts over the total width of the support plane.

12. The friction wheel singler according to claim 10 wherein the shafts with the feed rolls are distributed over the total length of the support plane.

13. The friction wheel singler according to claim 10, wherein the feed rolls are equipped over a limited circumference with friction segments with a high coefficient of friction and wherein the remaining circumference has a low coefficient of friction, the friction segments of all feed rolls all assuming the same angular position relative to the support plane on their associated shafts.

14. The friction wheel singler according to claim 13, wherein the friction segments of the feed rolls protrude out of the support plane on the shaft at the front in the transport direction of the bank note to be singled.

15. The friction wheel singler according to claim 13, wherein the singling cylinder forms with a retaining device a singling gap and is likewise equipped with friction segments that are so disposed and synchronized with the friction segments of the feed rolls that they take effect at the singling gap when the friction segments of the feed rolls dip down into the support plane with the shafts rotating in the transport direction of a sheet to be singled.

16. The friction wheel singler according to claim 15, wherein the singling cylinder and the feed rolls have matching outside diameters contacting the sheet to be singled.

17. The friction wheel singler according to claim 11, wherein the feed rolls attacking the trailing area of the bank note in the transport direction of the bank note to be singled have a lower coefficient of friction than the feed rolls toward the front in the transport direction.

18. The friction wheel singler according to claim 1, wherein a second half of the area of the retaining device is formed of a material with a negligibly low coefficient of friction as compared to the friction area of the retaining device.

* * * * *